United States Patent [19]

Rogers

[11] Patent Number: 4,860,995

[45] Date of Patent: Aug. 29, 1989

[54] VALVE ELEMENT FOR USE IN PUMPS FOR HANDLING FLUIDS CONTAINING ABRASIVE MATERIALS

[75] Inventor: John T. Rogers, Houston, Tex.

[73] Assignee: Utex Industries, Inc., Houston, Tex.

[21] Appl. No.: 183,652

[22] Filed: Apr. 19, 1988

[51] Int. Cl.[4] ..... F16K 15/00

[52] U.S. Cl. ..... 251/356; 137/516.29; 137/543.13; 137/902

[58] Field of Search ..... 137/543.13, 902, 516.29; 251/356, 332, 368; 417/900

[56] References Cited

U.S. PATENT DOCUMENTS

| | | | |
|---|---|---|---|
| 1,516,846 | 11/1924 | Dever | 137/543.13 |
| 1,716,896 | 2/1929 | Miller | 137/902 |
| 2,011,547 | 8/1935 | Campbell | 137/516.29 |
| 2,103,503 | 12/1937 | White | 137/516.29 |
| 2,163,472 | 6/1939 | Shimer | 137/516.29 |
| 3,324,880 | 6/1967 | Roberts et al. | 137/516.29 |
| 3,552,426 | 1/1971 | Hester | 137/375 |

FOREIGN PATENT DOCUMENTS

| | | | |
|---|---|---|---|
| 322393 | 1/1902 | France | 137/543.13 |

*Primary Examiner*—A. Michael Chambers
*Attorney, Agent, or Firm*—Browning, Bushman, Zamecki & Anderson

[57] ABSTRACT

A valve element for use in a high pressure pump, the valve element having a body portion with a top side and a bottom side, a guide means attached to and projecting away from the bottom side of the body portion and an insert secured to the top side of the body portion, the insert having a second giude which projects away from the top side of the body portion and an annularly extending flange which defines an annularly extending sealing surface, the insert being formed of a generally non-metallic material having a specific gravity less than the specific gravity of the material forming the body portion and the guide means projecting from the bottom side of the body portion.

16 Claims, 3 Drawing Sheets

VALVE ELEMENT FOR USE IN PUMPS FOR HANDLING FLUIDS CONTAINING ABRASIVE MATERIALS

BACKGROUND OF THE INVENTION

1. Field of the Invention

The present invention relates to valves for use in pumps handling abrasive laden fluids and, more particularly, to valve elements for use in piston pumps utilized in drilling and servicing of oil wells.

2. Description of the Background

In piston-type pumps such as triplex pumps which are used to pump drilling mud and other such abrasive laden fluids, a poppet valve comprised of a generally vertically disposed valve element and a valve seat is used to control the flow of fluid between an intake chamber and a discharge chamber. The valve element is biased, e.g. spring loaded, in the closed position. The action of the pump piston creates a suction in the discharge chamber forcing the valve element to open communication between the intake and discharge chamber, the valve element moving against the force of the spring. On the return stroke of the piston, the valve element, urged by the spring, moves down to engage the valve seat to seal off communication between the intake and the discharge chambers.

In pumps of the type under consideration, the valve element has an annular sealing surface which seals against a generally complimentary shaped seating surface provided by a valve seat disposed in the pump. Typically, the valve elements are provided with upper and lower guides in an attempt to ensure that the valve element stays aligned properly so as to allow the sealing surface on the valve element and the seating surface to properly mate when the valve element moves to the closed position. Thus, the valve element will have a central body portion which carries an annularly extending seat, the upper and lower guides projecting in opposite directions from the body portion.

Inherently, the structure of the valve element results in a high center of gravity. Accordingly, when the valve elements are moving from the open to the closed position, they have a tendency to tip or tilt off the true center line. This tendency to tip off center increases as the guides wear allowing more wobble of the valve element about the center line. Accordingly, rather than the sealing surface on the valve element engaging the seating surface at all points around its periphery substantially simultaneously, an area or a zone of the sealing surface strikes the seating surface first producing concentrated loading in this area as well as on a zone generally 180° opposite this area as the valve element rocks or bounces around until it seals around the full periphery.

Valve elements for use in pumps of the type under consideration are known wherein a resilient sealing insert is bonded or otherwise secured to a generally metallic valve element structure. However, in such valve elements, both the upper and lower guides as well as the generally centrally located body portion are metallic in nature, the upper and lower guides and the body portion generally forming a monolithic structure. Along with making the valve element top heavy with a high center of gravity, this construction increases the overall weight of the valve element.

SUMMARY OF THE INVENTION

It is therefore an object of the present invention to provide an improved valve element for use in pumps and check valves handling abrasive laden fluids or other liquids.

Another object of the present invention is to provide a valve element for use in piston or plunger-type pumps, check valves, etc. wherein the valve element has a relatively low center of gravity.

Another object of the present invention is to provide a valve element having an insert with an integrally formed upper guide and an annularly extending sealing surface.

The above and other objects of the present invention will become apparent from the drawings, the description given herein and the appended claims.

The valve element of the present invention has a body portion, metallic in construction, which has a top side, a bottom side and a generally circular periphery. A first guide means, also of metal, is attached to and projects away from the bottom side of the body portion, the body portion and the first guide means generally forming a monolithic structure. An insert is secured to the top side of the body portion. The insert includes a second guide means which projects away from the top side of the body portion. The insert further includes a flange portion which defines an annularly extending seal surface, the flange portion defining the seal surface and the second guide means being preferably, though not necessarily, formed as a monolithic structure. The insert is formed of a non-metallic material which has a specific gravity less than the specific gravity of the metallic material forming the body portion and the first guide means.

DESCRIPTION OF THE PREFERRED EMBODIMENTS

Figure 1:
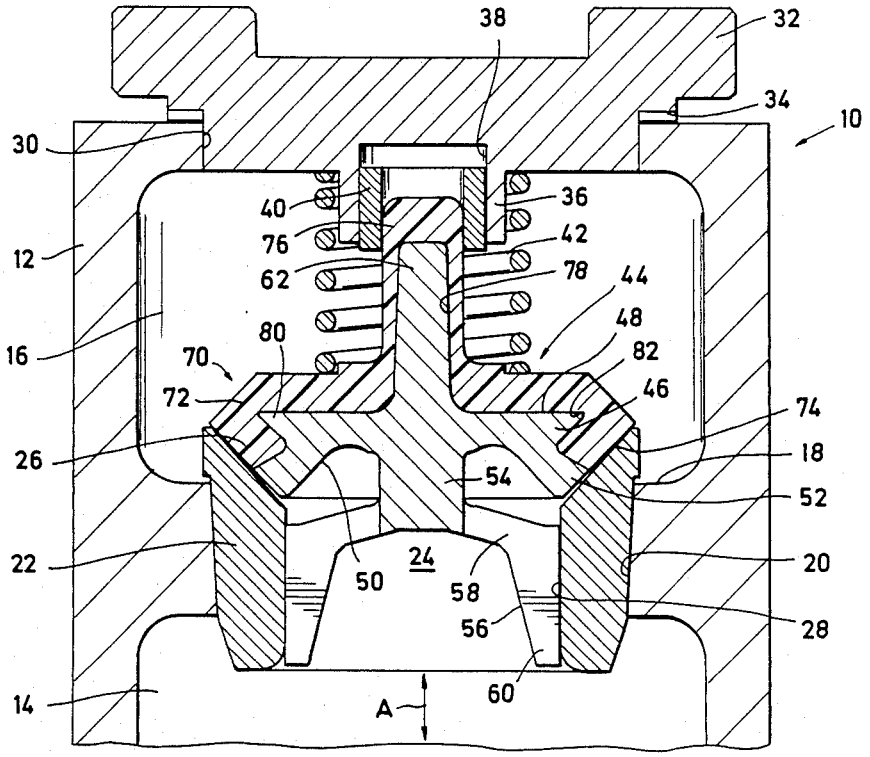
FIG. 1 is an elevational view, partly in section, of a typical valve assembly of a high pressure piston pump showing a valve element in accordance with the present invention.

Referring first to FIG. 1, a valve assembly, shown generally as 10, of a typical high pressure pump such as a piston pump, has a body portion 12 which forms an intake or pressure chamber 14 and a discharge chamber 16. An annular wall 18 has a generally frustoconical bore 20 therethrough in which is received a valve seat 22. Valve seat 22 defines a bore 24 providing open communication between intake chamber 14 and discharge chamber 16. Valve seat 22 has a frustoconical seating surface 26 and a generally cylindrical wall 28 which defines bore 24 and which, as seen hereafter, acts as a guide surface.

Body 12 has a valve access opening 30 which is normally closed by means of a cover 32, an annular gasket 34 providing a seal between cover 32 and body 12, cover 32 being secured by suitable means, not shown, to body 12. Projecting from cover 32 inwardly of chamber 16 is an annular boss 36 forming a cylindrical bore 38 for receipt of an annular valve guide bushing 40. Boss 36 also acts as a retainer to secure one extremity of a compression spring 42 which urges a valve element, shown generally as 44, into its closed or seated relationship with the seating surface 26 of valve seat 22.

The valve element 44 has a body portion 46 which has a top side 48 and a bottom side 50, body portion 46 having a generally circular periphery 52. Projecting downwardly and centrally from bottom side 50 is a neck portion 54 to which are attached a plurality of wings 56 which have a generally radially outwardly extending portion 58 and a generally downwardly extending portion 60, there generally being three or four of the wings 56. As can be seen, the vertical portion 60 of the wings 56 engage the cylindrical wall 28 of the valve seat 22 at generally equally spaced, circumferentially displaced points around the circumference of cylindrical wall 28 and thereby serve to guide valve element 44 as it moves downwardly to seat in valve seat 22. Thus, neck 54 and wings 56 form a guide of valve element 44. Projecting from the top side 48 of body 46 is a stem 62, stem 62 and neck 54 being generally coaxially aligned. As can be seen, body portion 46, neck 54, wings 56 and stem 62 are metallic in nature and form a monolithic structure.

Secured to the top side 48 of body portion 46 is an insert shown generally as 70. Insert 70, which is made of a material e.g. plastic, having a specific gravity less than the specific gravity of the material forming body portion 46 and the guide comprised of wings 56 and neck 54, has a flange portion 72 which defines an annularly extending sealing surface 74. As can be seen, sealing surface 74 has a generally frustoconical shape complimentary to seating surface 26 on valve seat 22. Integrally formed with flange portion 72 is a generally cylindrical guide 76, guide 76 being provided with a generally cylindrical, blind bore 78 extending generally axially through cylindrical member 76. As can be seen, bore 78 is sized so as to snuggly receive stem 62 when insert 70 is secured to body 46. Body 46 is provided with an annularly extending, dove-tailed projection 80 while flange portion 72 has an annularly extending, complimentary shaped recess 82 such that insert 70 can be mechanically locked to body portion 46 when annularly extending projection 80 is received in recess 82. In this regard, it will be observed that insert 70 is generally comprised of a plastic or plastic-like material which has a lower specific gravity than the specific gravity of the material of body 46 and which is usually more flexible whereby flange portion 72 can be distorted sufficiently to permit projection 80 and recess 82 to engage and mechanically lock the body 46 with the insert 70. Alternately, insert 70 may be bonded, in the well known manner, to body 46.

In operation, and as known to those skilled in the art, reciprocation of the piston (not shown) results in a suction being created in discharge chamber 16 which suction acts on valve element 44 moving it upward against spring 42 thereby drawing in fluid through bore 24 from chamber 14. As the valve element 44 moves upward, guides 76 and wings 56 serve to maintain valve element 44 on a generally center line passing vertically through the center of neck 54 and stem 62. As the piston now moves in the opposite direction, the fluid is discharged from chamber 16, valve element 44 now being urged downwardly by spring 42 until sealing surface 74 engages seating surface 26. As the piston reciprocates, the valve element 44 also reciprocates in the manner described above in the direction of arrow A, fluid being alternately drawn into and discharged from chamber 16.

Because of the generally lighter weight of insert 70, valve element 44 has a lower center of gravity than would be the case if flange 72 and cylindrical guide 76 were made of metal i.e. generally integrally formed with body 46. Accordingly, there is less tendency for valve element 44 to wobble or tip off center as it moves to the closed position thereby ensuring that sealing surface 74 will contact seating surface 26 generally uniformly around their respective peripheries. Moreover, insert 70 ensures that the overall weight of valve element 44 is reduced.

Figure 2:
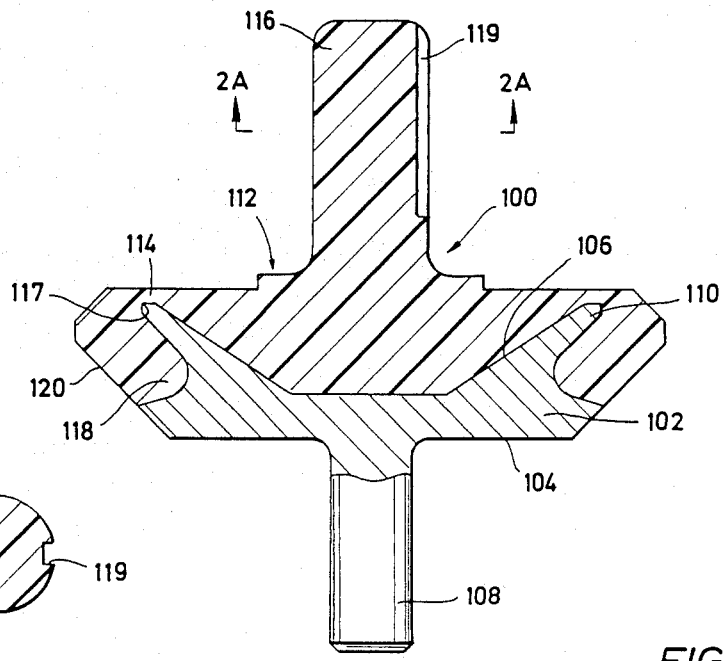
FIG. 2 is an elevational view, partly in section, of another embodiment of the valve element of the present invention.
Figure 2A:
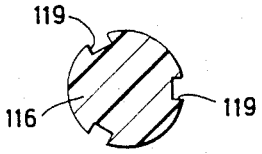
FIG. 2A is a cross-sectional view taken along the lines 2A—2A of FIG. 2.

Referring now to FIGS. 2 and 2A, there is shown another embodiment of a valve element in accordance with the present invention. The valve element 100 has a body portion 102, a bottom side 104 and a top side 106. Projecting from bottom side 104 is a cylindrical guide 108, guide 108 and body 102 forming a generally monolithic structure of a metallic material. Body 102 is also provided with an annularly extending rib 110 which is attached to top side 106 and flares generally upwardly and outwardly away from top surface 106. Valve element 100 is provided with an insert 112 secured to top side 100 of body 102 and made of a plastic or plastic-like material having a specific gravity less than the specific gravity of the material of body 102, insert 112 having a flange portion 114 and a guide portion 116. As can be seen, guide portion 116 and flange portion 114 comprise a monolithic structure. Flange portion 114 is also provided with an annularly extending recess 117 which is complimentary in shape to rib 110, rib 110 and recess 117 forming respective projecting-receiving formations permitting mechanical interlocking of insert 112 to body 102. Flange 114 is also provided with an annular lip portion 118 which defines an annularly extending sealing surface 120. Whereas the valve element 44 shown in FIG. 1 has a generally cylindrical top guide and a wing type bottom guide, guides 116 and 108 of valve element 100 are both generally cylindrical members which are coaxial with one another. As in the case described above with respect to valve element 44, insert 112 can either be mechanically secured to body 102 or bonded thereto. As will be appreciated, because virtually the entire upper portion of valve element 100 formed by valve insert 112 is of a relatively light weight material as compared to the material of body 102 and guide 108, the center of gravity of valve element 100 is substantially lowered and the overall weight of valve element 100 is reduced. Guide 116 is also provided with three circumferentially spaced, generally parallel aligned grooves 119 which extend axially along guide 116. As seen, grooves 119 are displaced approximately 120° from one another and while three grooves 119 are shown, a greater or lesser number can be employed provided that they are generally equidistant in spacing so as to not detract unnecessarily from the symmetry of valve element 100. Grooves 119 serve as fluid passages to permit the escape of any fluid trapped by guide 116 in cylindrical bore 38 when valve element 44 moves upwardly against spring 72. The presence of a fluid passage such as groove 119 also minimizes wearing between guide 116 and valve guide bushing 40 in as much as the fluid, which as noted may be laden with abrasives, will selectively pass out of bore 38 through the grooves 119 rather than being forced between closely fitting surfaces of guide 116 and guide bushing 40.

Figure 3:
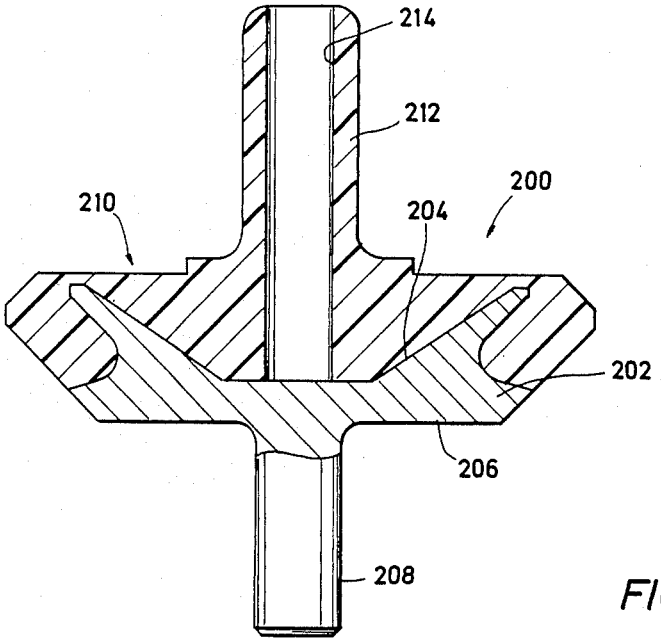
FIG. 3 is an elevational view, partly in section, of another embodiment of the valve element of the present invention.

Referring now to FIG. 3 there is shown yet another embodiment of the valve element of the present invention. The valve element shown generally as 200 has a metallic body portion 202 with a top side 204 and bottom side 206. Bottom guide 208 and body portion 206 form a generally monolithic, metallic structure. Insert 210 of valve element 200 is substantially the same as insert 112 of valve element 100 with the exception that whereas guide 116 is a substantially solid cylindrical member, guide 212 is provided with a cylindrical bore 214 which extends along the length of cylindrical guide 112 and which is open at its upper most part as seen. As is the case with valve element 100, valve or insert 210 can be mechanically locked to body 202 or bonded thereto, body 202 and insert 210 both being provided with respective projecting and receiving formations to allow mechanical interlocking of the two. It will be appreciated that valve element 200 would have an even lower center of gravity than valve element 100 since the mass of insert 210 has been further reduced by making guide 212 substantially hollow i.e. with bore 214.

Figure 4A:
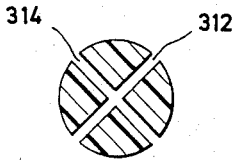
FIG. 4A is a cross-sectional view taken along the lines 4A—4A of FIG. 4.
Figure 4:
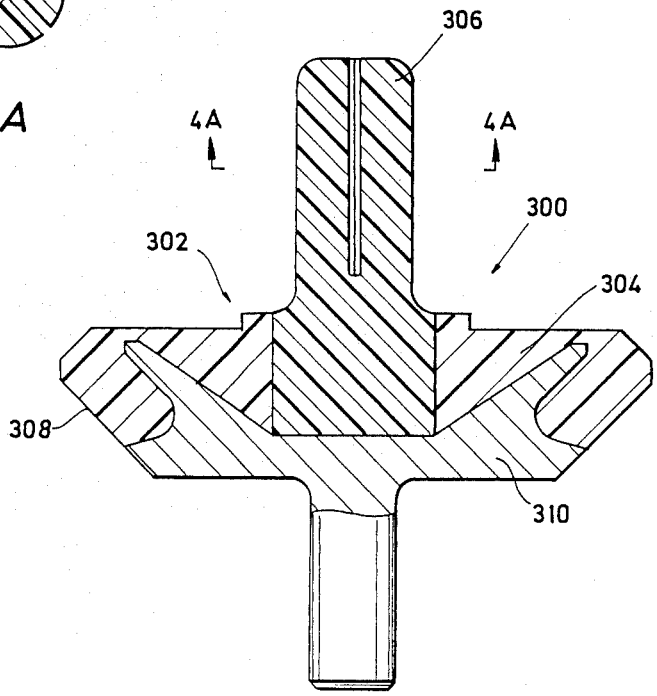
FIG. 4 is an elevational view, partly in section, of another embodiment of the valve element of the present invention.

Referring now to FIGS. 4 and 4A, there is shown yet another embodiment of the valve element of the present invention. The valve element 300 shown in FIG. 4 is substantially identical to valve elements 100 and 200 with the exception that insert 302 is comprised of a flange portion 304 and guide portion 306 which are made of different materials. Flange portion 304, which forms an annularly extending sealing surface 308, is comprised of a relatively soft or resilient material whereas guide 306, while it is also plastic or of a plastic-like material is relatively harder and less resilient than the material of flange 304. This allows sealing surface 308 to effect better sealing with the seating surface in the valve assembly while ensuring that valve guide 306 is sufficiently rigid and hard enough to resist bending or excessive wearing. Flange 304 and guide 306 can be formed separately and then simply bonded together along their intersecting surfaces. As is the case with the valve elements previously described, valve element 300 has a relatively low center of gravity since valve insert 302 is comprised of a material having a specific gravity less than the specific gravity of the body 310 of valve element 300. As can also be seen with reference to FIG. 4A, a upper guide 306 is provided with slots 312 and 314 which are generally at right angles to one another and extend axially through upper guide 306. Slots 312, 314, like grooves 119 shown in FIG. 2, serve as fluid passages to allow the escape of fluid which might be trapped by guide 306 in the cylindrical bore 38 (see FIG. 1). The slots 312, 314, like the grooves 119, help to minimize wearing between the guide 306 and the guide bushing by allowing any abrasive laden fluid to pass through the slots rather than between closely adjacent surfaces of the guide bushing and the guide 306.

Figure 5:
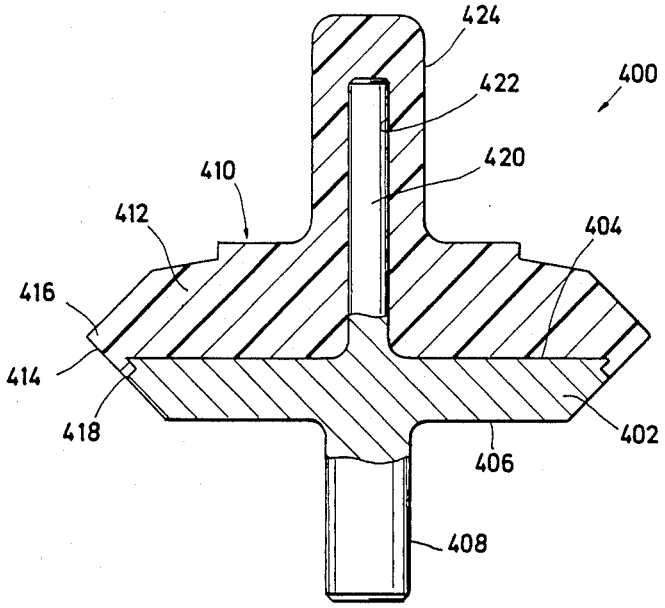
FIG. 5 is an elevational view, partly in section, of another embodiment of the valve element of the present invention.

FIG. 5 shows a slightly modified embodiment of the valve element of the present invention. The valve element of FIG. 5, shown generally as 400, has a body portion 402 with a substantially planar top side 404 and a substantially planar bottom side 406. Projecting from bottom side 406 is bottom guide 408, guide 408 and body 402 being formed of a monolithic, metallic structure. Insert 410 has a flange portion 412 which defines an annularly extending sealing surface 414 formed from a lip 416 which is received in an annular undercut notch 418 in the periphery of body 402. Projecting from the top side 404 of body 402 is a stem 420, stem 420 being metallic in nature and, with body 402 and guide 408 forming a generally monolithic structure. Cylindrical stem 420 is received in a cylindrical, blind bore 422 formed in the top guide 424 of insert 410. As can be seen, guide 424 forms a generally cylindrical member and flange 412 comprises a monolithic structure formed of a plastic or plastic-like material having a lower specific gravity than that of the metallic material from which body 402, guide 408 and stem 420 are formed. Accordingly, valve element 400 has a lower center of gravity than would be the case if valve insert 410 were formed of metal and metallic parts as is the case in prior art structure. As in the other valve elements described, insert 410 can be bonded to body 402.

Figure 6:
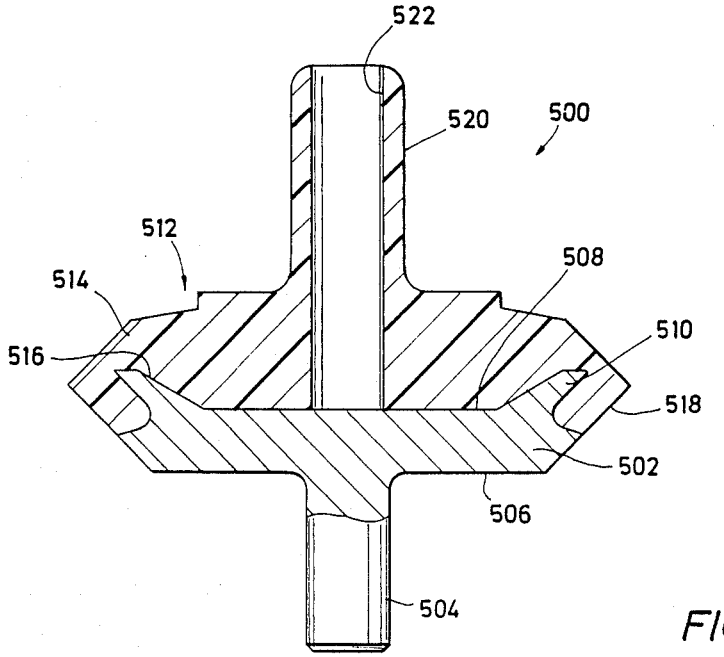
FIG. 6 is an elevational view, partly in section, of another embodiment of the valve element of the present invention.

With reference to FIG. 6, it can be seen that the valve element 500 is quite similar to valve element 400 shown in FIG. 5. Valve element 500 has a body portion 502 and a cylindrical bottom guide 504 projecting from the bottom side 506 of body 502. Projecting from the top side 508 of body 502 is an annularly extending rib 510, rib 510 flaring generally upwardly and outwardly from top side 508 of body 502. Insert 512 has a flange portion 514 provided with an annularly extending recess 516 which is complimentary in shape to rib 510 and which receives rib 510 when insert 512 is secured to body 502. Flange 514 also defines an annularly extending sealing surface 518 and a generally cylindrical upper guide 520 provided with a cylindrical bore 522 extending axially along guide 520, bore 522 being open at its uppermost end as shown. The projecting receiving formation which is defined by rib 510 and recess 516 permit insert 512 to be mechanically interlocked to body 502 although it will be appreciated that insert 512 can be bonded to body 502 if desired. Unlike valve element 400 wherein the body 402 is provided with a stem 420 which is received in the top guide 424, no such stem projects from body 502. This results in an even lowered center of gravity of valve element 500 as compared with valve element 400 particularly in view of the fact that upper guide 520 is substantially hollow due to the presence of bore 522.

As can be seen, the valve elements of the present invention wherein the valve insert is formed of a material having a lower specific gravity than the material forming the body and bottom guide of the valve elements, provides the valve element with a lower center of gravity and which will therefore seat in a more uniform fashion as the valve element closes. The valve elements made in accordance with the present invention can be of various types, as shown above, wherein the upper and lower guides are formed by substantially cylindrical shaped members, coaxial with one another, or wherein the bottom guide is of the so called "wing type" wherein a series of legs or wings project outwardly of a central neck portion such as shown in FIG. 1.

As seen above, while in most of the valve elements described, the upper guide and the flange portion which forms the annular sealing surface are monolithic in nature, the upper guide and the flange may be formed separately and then secured together as per FIG. 4. This permits the material of the guide and material of the flange to be different to accommodate different needs. For example, it may be desirable to make the flange portion of the insert from a softer, more resilient material to effect better sealing against the seating surface and to construct the guide from a harder, more abrasion resistant material so as to reduce the wearing of the guide which, as noted above, contributes to off center closing of the valve.

The insert can be formed from a wide variety of materials, the only requisite being that such materials have a lower specific gravity than the material forming the body and lower guide of the valve element. Thus, the insert can be made from a wide variety of thermoplastic or thermosetting resins, or combinations thereof. Non limiting examples include nylon, polyesters, polyurethanes, polycarbonates, rubbers, etc. The insert can be generally homogeneous in nature i.e. formed of a single material, or heterogeneous in nature wherein a plastic or resinous material contains a filler to impart strength or wear resistant properties to the insert. Such fillers or reinforcements can include flocs, fibers, etc. of various materials such as metallic fibers, synthetic or natural fibers, etc. Portions of the insert can be provided with anti-extrusion heals or backups as needed. For example, a peripheral portion of the flange portion of the insert can be provided with an anti-extrusion heal so as to prevent the portion of the flange which forms the annular sealing surface from being extruded under the action of the high pressure fluid when the valve is in the closed position.

As pointed out above, the insert can be either bonded to the body portion of the valve element or it can be mechanically locked thereto. Bonding of plastic and plastic-like materials to metal parts is well known to those skilled in the art. In cases where the insert is bonded to the metallic body, it is generally not necessary to provide the insert and the body with respective receiving-projecting formations since effective bonding can be achieved across generally planar surfaces. However, the use of said such projecting-receiving formations coupled with bonding increases the overall integrity of the valve element. It will be appreciated that many projecting-receiving formations providing complimentary interengaging or interlocking portions of the insert and the metallic body can be employed. It is only necessary that the insert be secured to the body portion, whether that be by bonding, mechanical locking, or a combination thereof, such that the insert does not separate from the body when the valve element is in use.

It will be appreciated that the valve element of the present invention which in most cases is comprised of a monolithic structure of metal secured to a monolithic structure of a plastic or plastic-like material is much simpler in construction than many of the prior art valve element assemblies. Many such prior art valve elements employed a plastic-like or rubber annular member mechanically secured to the valve element by a series of metallic plates, washers and threaded members which increased the overall weight and raised the center of gravity of the valve element. Moreover, in such valve elements, both the upper and lower guides were metallic in nature and, in virtually all cases, formed a monolithic metallic structure with the body portion of the valve element.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A valve element having a lowered center of gravity comprising:

a body portion having a top side and a bottom side;

a first guide means attached to and projecting downwardly away from said bottom side of said body portion; and an insert secured to said top side of said body portion, said insert including a second guide means projecting upwardly away from said top side of said body portion and a flange portion defining an annularly extending sealing surface, said flange portion being disposed between the first and second guide means, said insert being formed of a substantially non-metallic material having a specific gravity less than the specific gravity of material forming said body portion and said first guide means.

2. The valve element of claim 1 wherein said body portion and said first guide comprise a monolithic structure.

3. The valve element of claim 1 wherein said first guide means comprises a generally cylindrical member.

4. The valve element of claim 1 wherein said first guide means includes a neck portion attached to the bottom side of said body portion and a plurality of legs depending generally outwardly and downwardly from said neck portion distal said bottom side of said body portion.

5. The valve element of claim 1 wherein said second guide means comprises a generally cylindrical member.

6. The valve element of claim 5 wherein said cylindrical member has a generally central bore extending at least partially axially therethrough.

7. The valve element of claim 5 including a spindle attached to and projecting away from said top side of said body portion, said spindle being received in said bore formed in said cylindrical member.

8. The valve element of claim 1 wherein said insert is secured to said body portion by bonding said flange portion to said top side of said body portion.

9. The valve element of claim 1 including means to mechanically lock said insert to said body portion.

10. The valve element of claim 1 wherein said flange portion defining said annularly extending seal surface is comprised of a material which is more resilient than the material of said second guide means.

11. The valve element of claim 1 wherein said first and second guide means comprise cylindrical members which are generally coaxially aligned.

12. The valve element of claim 1 wherein said insert comprises a monolithic structure.

13. The valve element of claim 3 wherein said first guide means includes means forming a fluid passageway extending generally axially along said first guide means.

14. The valve element of claim 13 wherein said means forming said fluid passageway comprises a plurality of grooves formed on and extending axially along said cylindrical member, said grooves being generally parallel and equally spaced from one another.

15. The valve element of claim 13 wherein said means forming said fluid passageway comprises at least one slot extending axially through said cylindrical member.

16. The valve element of claim 15 wherein there are two of said slots, each of said slots dissecting said cylindrical member.

* * * * *